US007712185B2

(12) United States Patent
Pyo

(10) Patent No.: US 7,712,185 B2
(45) Date of Patent: May 11, 2010

(54) DOOR HINGE DEVICE FOR ABSORBING THE CLOSING IMPACT OF FURNITURE DOOR

(75) Inventor: Chul Soo Pyo, Seoul (KR)

(73) Assignee: Samsung Precision Industrial Co., Ltd., Seo-Gu Icheon (KR)

( * ) Notice: Subject to any disclaimer, the term of this patent is extended or adjusted under 35 U.S.C. 154(b) by 0 days.

(21) Appl. No.: 12/245,422

(22) Filed: Oct. 3, 2008

(65) Prior Publication Data

US 2009/0165244 A1 Jul. 2, 2009

(30) Foreign Application Priority Data

Dec. 27, 2007 (KR) ..... 10-2007-0138226

(51) Int. Cl.
*E05F 1/08* (2006.01)

(52) U.S. Cl. ..... 16/286; 16/250

(58) Field of Classification Search ..... 16/286–288, 16/366, 370, 374, 375, 86, 86 R, 86 A, 49, 16/51, 54, 68; 292/DIG. 15, DIG. 19; 49/386; 411/41, 45, 46, 508
See application file for complete search history.

(56) References Cited

U.S. PATENT DOCUMENTS 3,763,519 A * 10/1973 Favre ..... 16/72
4,403,377 A * 9/1983 Mizusawa ..... 24/681
5,507,545 A * 4/1996 Krysiak ..... 296/97.9
5,775,860 A * 7/1998 Meyer ..... 411/46
5,855,347 A * 1/1999 Hollingsworth et al. ..... 248/220.41
6,176,660 B1 * 1/2001 Lewis et al. ..... 411/45
6,366,465 B1 * 4/2002 Baur et al. ..... 361/752
6,415,478 B1 * 7/2002 Watanabe et al. ..... 16/444
6,591,454 B2 * 7/2003 Brustle ..... 16/374
7,275,284 B2 * 10/2007 Lautenschlager et al. ..... 16/287
2006/0026792 A1 * 2/2006 Brustle et al. ..... 16/54
2008/0271294 A1 * 11/2008 Lautenschlager ..... 16/374
2009/0119876 A1 * 5/2009 Pecar et al. ..... 16/293

FOREIGN PATENT DOCUMENTS

JP 6-248844 9/1994
JP 2006-2374 1/2006
JP 2006-169777 6/2006
KR 20-0432780 11/2006
WO WO 2005108726 A1 * 11/2005

* cited by examiner

*Primary Examiner*—Chuck Y. Mah
(74) *Attorney, Agent, or Firm*—Haynes and Boone, LLP

(57) ABSTRACT

Disclosed herein is a door hinge device for absorbing the closing impact of a furniture door, which is adapted to minimize a work load and the number of work processes thereof according to assembly and disassembly thereof through the modification of a retaining structure thereof. The door hinge device includes a furniture hinge 10, a damper adapter 20 and a covering member 30. According to the present invention, since the assembly and disassembly of the door hinge device can be performed in a one-touch manner through the interaction between the damper adapter and the covering member, a convenience of the operation according to the assembly and disassembly of the door hinge device is improved, a work load is reduced, and a safety accident such as injury of hands and the like is prevented.

5 Claims, 7 Drawing Sheets

(a)

(b)

(c)

DOOR HINGE DEVICE FOR ABSORBING THE CLOSING IMPACT OF FURNITURE DOOR

CROSS-REFERENCE TO RELATED APPLICATIONS

This application claims the benefit under 35 U.S.C. §119 (a) of Korean Patent Application No. 10-2007-0138226, filed in the Korean Intellectual Property Office on Dec. 27, 2007 and registered in KIPO on Mar. 12, 2008 (Registration No. 10-0814739), the entire disclosure of which is incorporated herein by reference.

BACKGROUND OF THE INVENTION

1. Field of the Invention

The present invention relates to an improved door buffering device which is installed at a path where a door for furniture is opened/closed to absorb a noise generated upon the closing impact of the furniture door, and more particularly, to a door hinge device for absorbing the closing impact of a furniture door, which is adapted to minimize a work load and the number of work processes thereof according to assembly and disassembly thereof through the modification of a retaining structure thereof.

2. Background of the Related Art

In general, a door buffering device, i.e., a door hinge device for absorbing the closing impact of a furniture door is mounted at on the inner wall or the front side of pieces of furniture such as sinks, drawers or the like so as to absorb the impact noise or contact resistance generated in the course of closing the door. Such a door hinge device is configured such that a damper adapter having a built-in fluid damper is mounted on a top surface or a side surface of a hinge for furniture.

For example, as shown in FIG. 1, a furniture hinge 10 of the door hinge device is hingeably mounted to a coupling portion between a side wall W of a piece of furniture and a furniture door D and serves as rotating means of the furniture door D. A damper adapter 20 having a built-in fluid damper 21 is mounted on a top surface of the furniture hinge 10.

Also, as shown in FIG. 2, a door hinge device for absorbing the closing impact of a furniture door (Korean Registration No. 731335) which is a prior application invention filed by the present applicant includes: a furniture hinge 10 adapted to hingeably interconnect a side wall W of a piece of furniture and a furniture door D and having at least one tension adjustment bolt 11 and a fixing bolt 15 mounted thereon; a damper adapter 20 mounted to the furniture hinge 10 by means of fixing means thereof, the damper adapter having a fluid damper 21 built therein for absorbing the closing impact of the furniture door D and a plurality of check openings 22 formed thereon to correspond to the tension adjustment bolt 11 and the fixing bolt 15 of the furniture hinge; and a covering member 30 fixedly mounted to the damper adapter 20 by means of retaining hooks 31 and adapted to selectively close or open the check openings 22 of the damper adapter 20.

As shown in FIG. 3, the fixing means of the damping adapter 20 includes a hook 27 formed integrally on the underside of the damping adapter 20 so as to be fittingly coupled to a retaining aperture 14 of the furniture hinge 10, and an elastic piece 28 fixedly mounted to the underside of the damper adapter 20 by means of fastening means such as a bolt, etc., so as to be retained by a flange portion 17 of a rear end of the furniture hinge 10.

Thus, in case where it is desired to fixedly mount the damper adapter 20 to the furniture hinge 10, when the elastic piece 28 is hooked on the flange portion 17 of the furniture hinge 10 and the hook 27 is pressingly pushed into the retaining aperture 14 while abutting against the retaining aperture 14 of the furniture hinge 10, the hook 27 of the damper adapter 20 is inserted into the retaining aperture 14 of the furniture hinge 10 and simultaneously the elastic piece 28 is retained by the flange portion 17 to cause the damper adapter 20 to be fixedly mounted to the furniture hinge 10.

On the other hand, in case where it is desired to separate the damper adapter 20 from the furniture hinge 10, the hook 27 fit into the retaining aperture 14 is lifted upwardly while the damper adapter 20 is slightly pulled forwardly with a user's hand so as to cause the hook 27 to be withdrawn from the furniture hinge 10 and the elastic piece 28 to be removed from the flange portion 17.

By the way, as shown in FIG. 3, the furniture hinge 10 and the damper adapter 20 are constructed to be fixed by means of the hook 27 and the elastic piece 28. Thus, when it is desired to mount the damper adapter 20 to the furniture hinge 10, the hook 27 should be pressingly pushed into the retaining aperture 14 while forwardly pulling the damper adapter 20 in a state where the elastic piece 28 is hooked on the flange portion of the furniture hinge 10, leading to an increase in a work load.

That is, since the damper adapter 20 must be pressed with a strong force of the extent of exceeding the elastic force of the elastic piece 28 and the hook 27 in a state where both side portions of the damper adapter 20 are gripped by the user's hand, it is difficult to mount the damper adapter 20 to the furniture hinge 10. Also, in case where the user's hand is slipped from the damper adapter 20 during the exertion of a strong force to the damper adapter 20 by a user, there is a risk that the user's hand will be injured.

In addition, in case where it is desired to separate the damper adapter 20 mounted on the furniture hinge 10, the hooking state of the hook 27 must be released to separate the elastic piece 28 in a state where the damper adapter 20 are pressed forwardly while being gripped by the user's hand, so that there is an increase in a work load according the separation of the damper adapter 20 and inconvenience is caused.

Therefore, the conventional door hinge device for absorbing the closing impact of the furniture door entails a problem in that it is difficult to horizontally and vertically apply a proper force to the damper adapter 20 in the course of the installation and separation of the damper adapter 20, making it difficult for general persons but not experts to install and separate the damper adapter 20.

SUMMARY OF THE INVENTION

Accordingly, the present invention has been made in an effort to solve the aforementioned problems associated with the prior art, and it is an object of the present invention to provide a door hinge device for absorbing the closing impact of a furniture door, which is adapted to minimize a work load and the number of work processes thereof according to assembly and disassembly thereof through the modification of a retaining structure thereof.

To accomplish the above object, according to the present invention, there is provided a door hinge device for absorbing the closing impact of a furniture door, the door hinge device including: a furniture hinge adapted to hingeably interconnect a side wall of a piece of furniture and a furniture door and having a retaining aperture formed thereon; a damper adapter fixedly mounted to the furniture hinge and having a fluid damper built therein for absorbing the closing impact of the furniture door, the damper adapter having a fixing hook and a pair of clearance hooks protrudingly formed downwardly from the underside thereof so as to be fittingly coupled to the retaining aperture, wherein the fixing hook and the clearance hooks are disposed abreast and a clearance space is defined between the fixing hook and each clearance hook; and a covering member mounted on the damper adapter and having one or more coupling protrusions formed on the underside thereof so as to be fit into the clearance space via a through-hole of the damper adapter, whereby the clearance hooks of the damper adapter are oriented uprightly by means of the coupling protrusions of the covering member so as to be fixedly retained by the retaining aperture.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to a preferred embodiment of the present invention with reference to the attached drawings.

Figure 1:
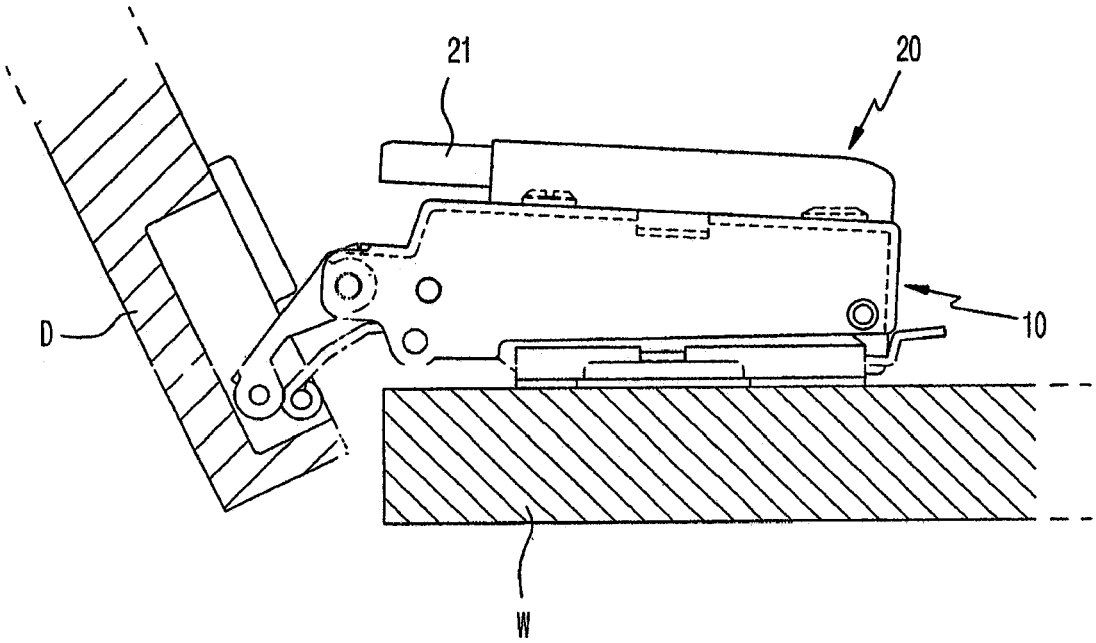
FIG .1 (Prior Art)
FIG. 1 is a diagrammatical view illustrating a state in which a conventional door hinge device is installed at a piece of furniture according to the prior art.
Figure 2:
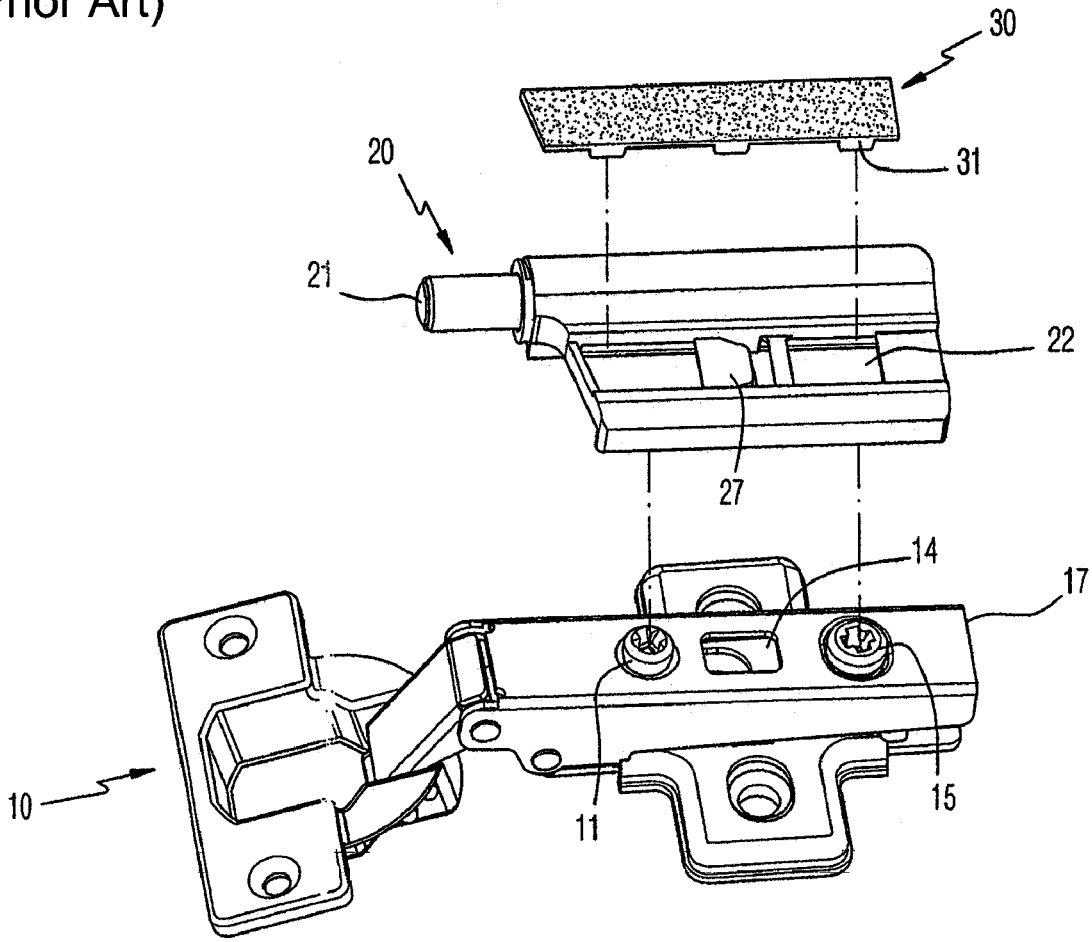
FIG .2 (Prior Art)
FIG. 2 is an exploded perspective view of a door hinge device according to the prior art.
Figure 3:
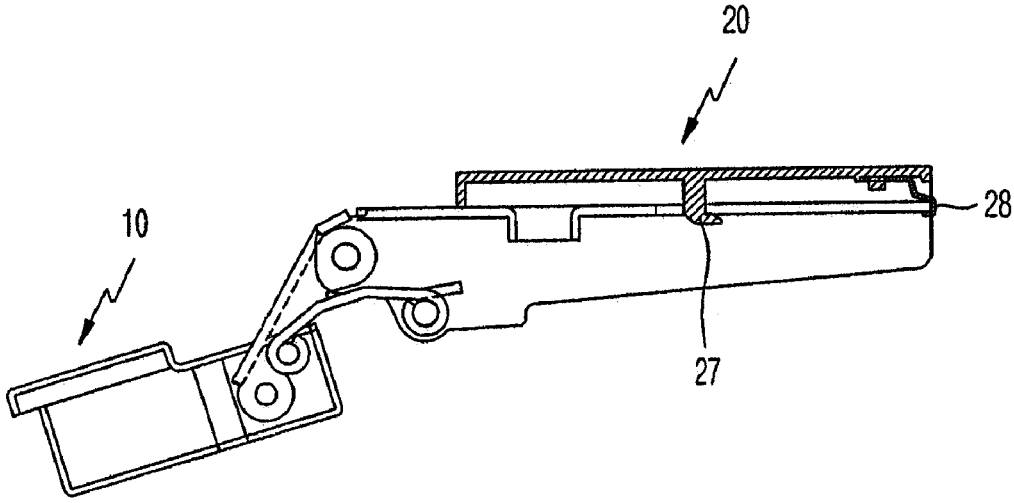
FIG .3 (Prior Art)
FIG. 3 is an assembled cross-sectional view of a door hinge device according to the prior art.
Figure 4:
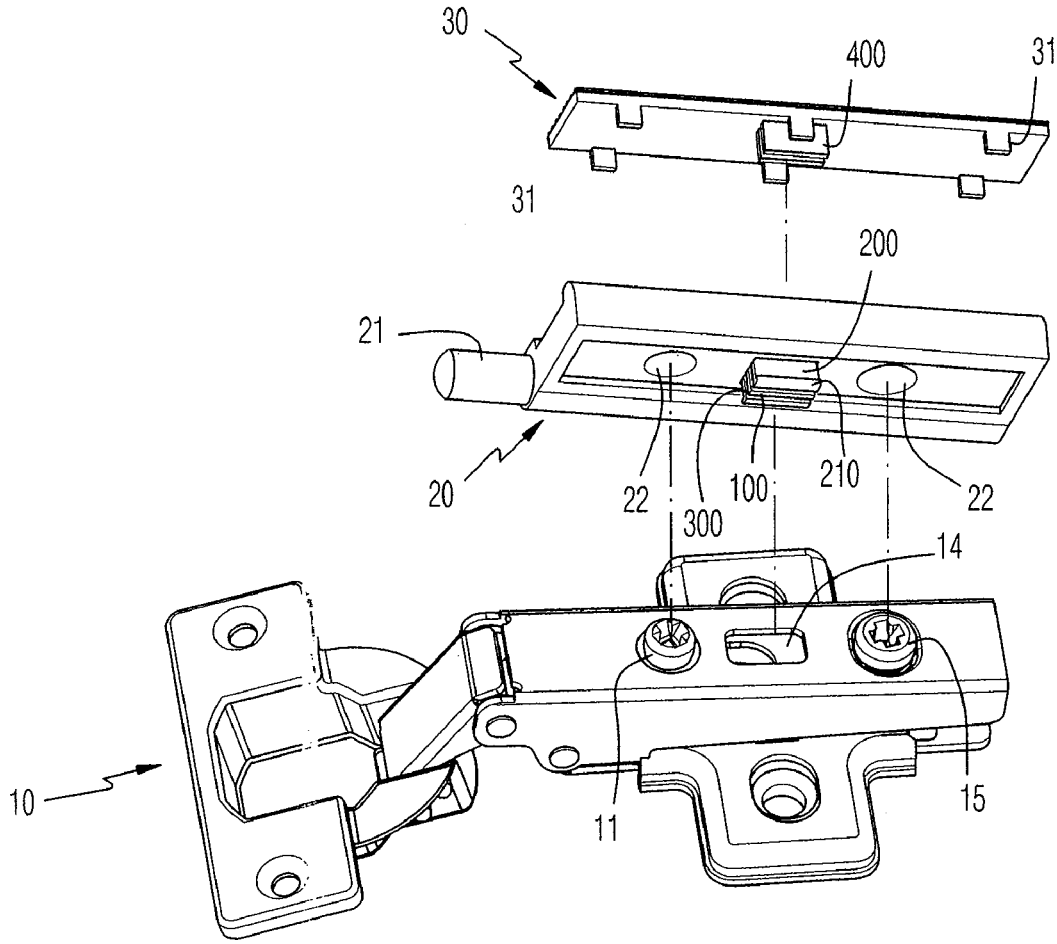
FIG. 4 is an exploded perspective view of a door hinge device according to a first embodiment of the present invention.
Figure 5:
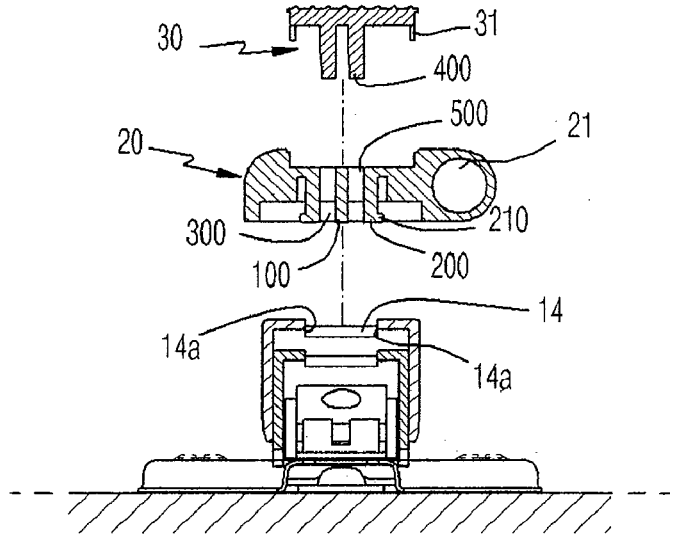
FIG. 5 is a cross-sectional view showing a series of assembly processes of the door hinge device of FIG. 4.
Figure 5:
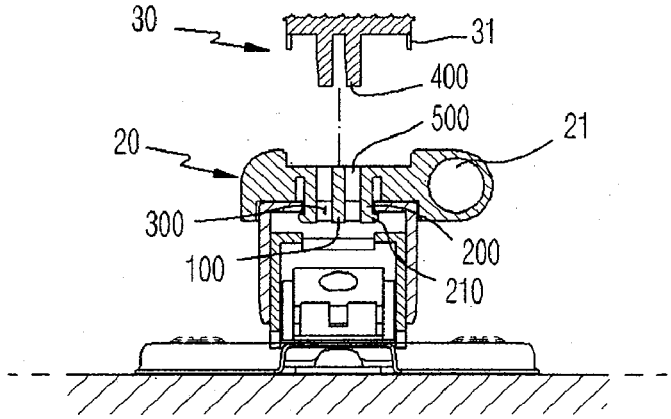
Figure 5:
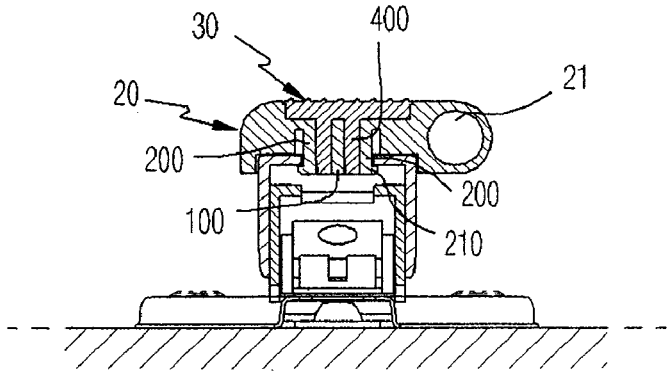
Figure 6:
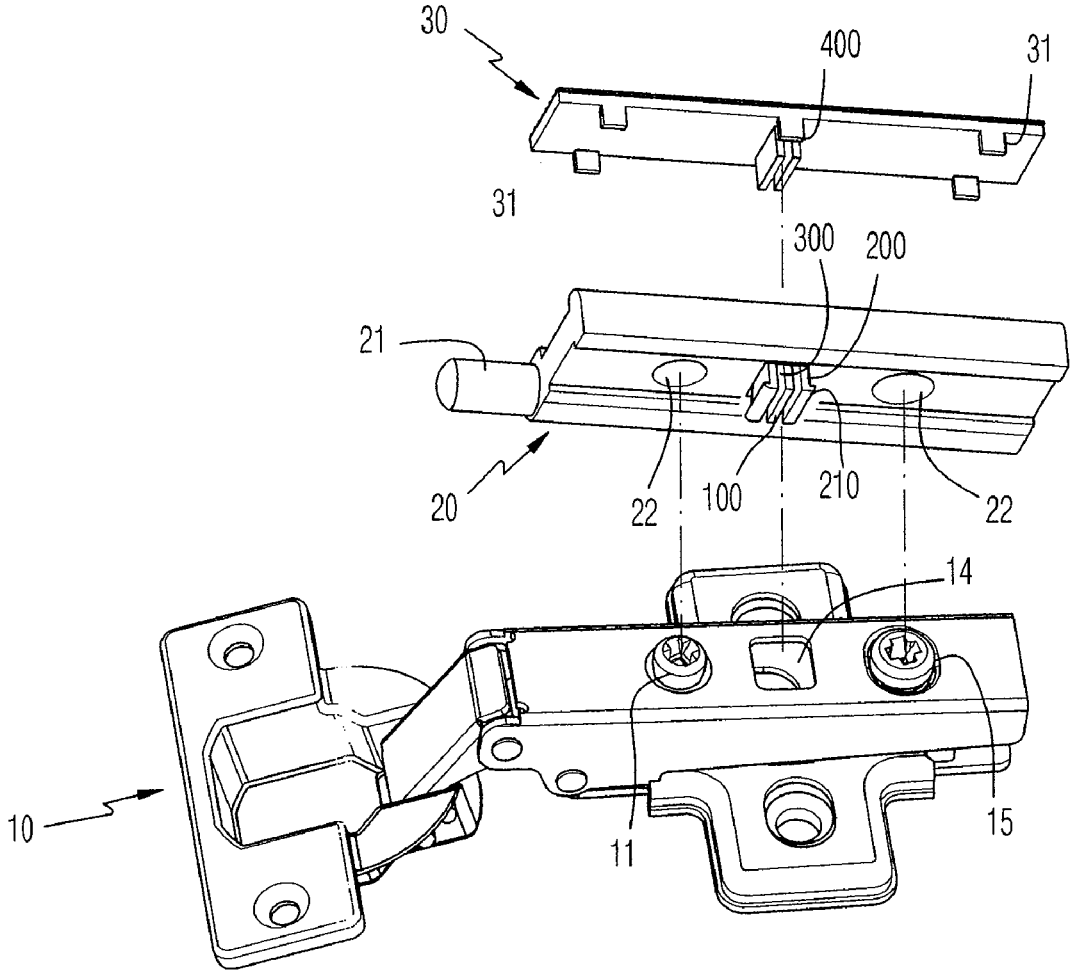
FIG. 6 is an exploded perspective view of a door hinge device according to a second embodiment of the present invention.
Figure 7:
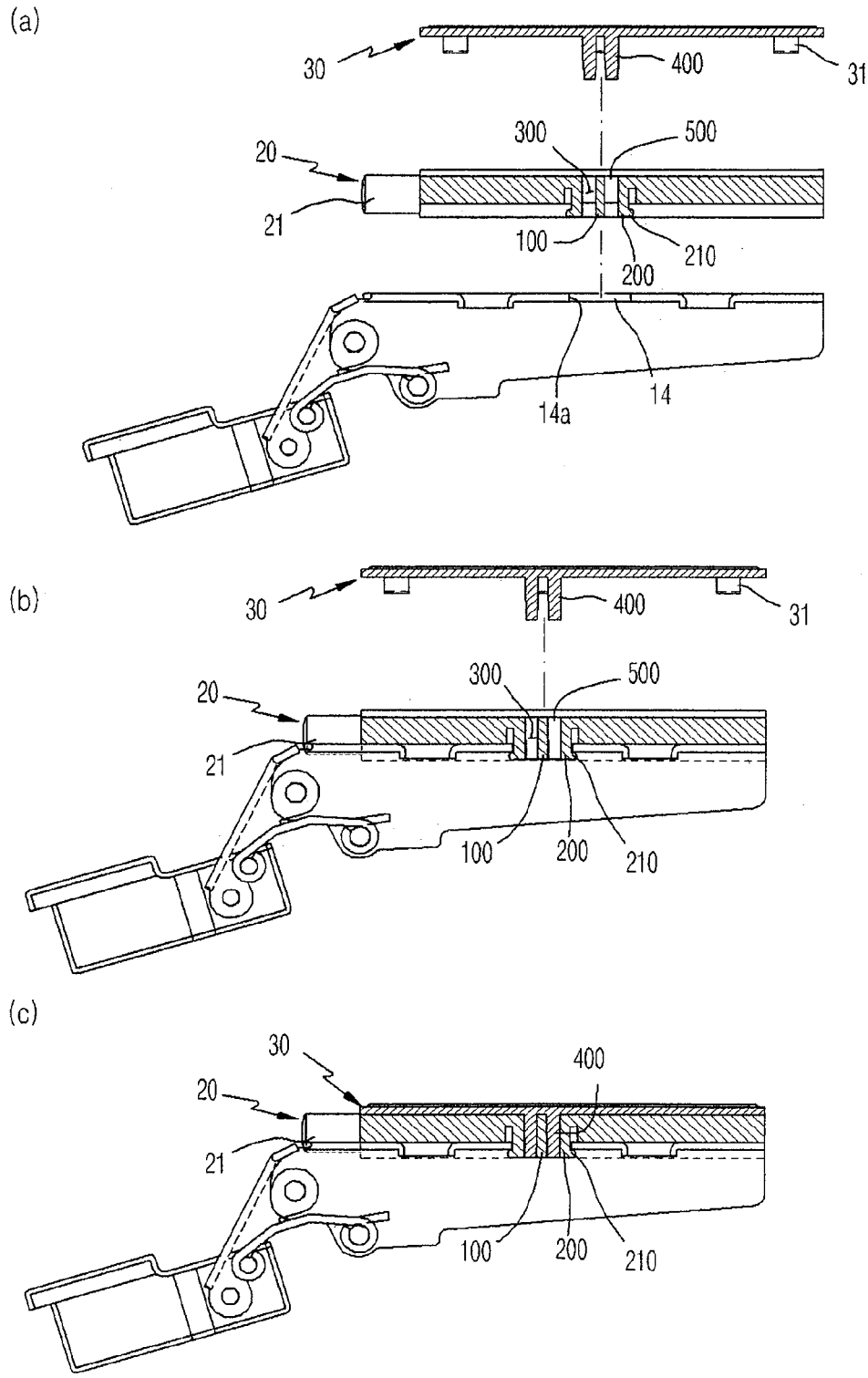
FIG. 7 is a cross-sectional view showing a series of assembly processes of the door hinge device of FIG. 6.

FIG. 4 is an exploded perspective view of a door hinge device according to a first embodiment of the present invention, FIG. 5 is a cross-sectional view showing a series of assembly processes of the door hinge device of FIG. 4, FIG. 6 is an exploded perspective view of a door hinge device according to a second embodiment of the present invention, and FIG. 7 is a cross-sectional view showing a series of assembly processes of the door hinge device of FIG. 6.

A door hinge device for absorbing the closing impact of a furniture door according to the present invention includes: a furniture hinge 10 adapted to hingeably interconnect a side wall W of a piece of furniture and a furniture door D and having a retaining aperture 14 formed thereon; a damper adapter 20 fixedly mounted to the furniture hinge 10 and having a fluid damper 21 built therein for absorbing the closing impact of the furniture door D, the damper adapter having a fixing hook 100 and a pair of clearance hooks 200 protrudingly formed downwardly from the underside thereof so as to be fittingly coupled to the retaining aperture 14, wherein the clearance hooks are disposed abreast at both sides of the fixing hook and a clearance space is defined between the fixing hook and each clearance hook; and a covering member 30 mounted on the damper adapter 20 and having one or more coupling protrusions 400 formed on the underside thereof so as to be fit into the clearance space via a through-hole 500 of the damper adapter 20. In this case, the clearance hooks 200 of the damper adapter 20 are oriented uprightly by means of the coupling protrusions 400 of the covering member 30 so as to be fixedly retained by the retaining aperture 14.

In this embodiment, the present invention includes a furniture hinge 10 adapted to interconnect the side wall W of a piece of furniture and the furniture door D so as to be used as rotating means of the furniture door D, a damper adapter 20 mounted on the top surface of the furniture hinge 10 so as to be used as buffering means of the furniture door D, and a covering member 30 mounted on the damper adapter 20 so as to be used as fixing means of the damping adapter 20.

Also, the constituent elements corresponding to the prior art in the main constituent elements of this embodiment are denoted by the same reference numerals as those used in the prior art.

In this case, the furniture hinge 10 is adapted to hingeably interconnect the side wall W of a piece of furniture and the furniture door D so as to be used opening/closing means of the furniture door D. The furniture hinge 10 includes a body portion securely fixed to the side wall W of the piece of furniture by means of bolts, and a rotating portion securely fixed to the furniture door D by means of bolts in such a fashion as to be hingeably coupled to the body portion.

The body portion of the furniture hinge 10 has at least one tension adjustment bolt 11 and a fixing bolt 15 mounted on a top surface thereof so as to adjust a tension or a fixing force of the rotating portion. Also, the body portion has at least one retaining aperture 14 formed between the tension adjustment bolt 11 and the fixing bolt 15 on the top surface thereof.

Also, the damper adapter 20 is fixedly mounted to the furniture hinge 10 and serves to buffer the closing impact of the furniture door D. The damper adapter 20 includes: a body portion having a check opening 22 formed at positions thereof corresponding to the tension adjustment bolt 11 and the fixing bolt 15 of the furniture hinge 10; and fixing means formed integrally on the underside of the body portion thereof.

In addition, the fixing means of the damper adapter 20 includes a fixing hook 100 protrudingly formed downwardly from the underside of the damper adapter 20 so as to be fittingly coupled to the retaining aperture 14, a pair of clearance hooks 200 protrudingly formed downwardly from the underside thereof in such a fashion as to be disposed abreast at both sides of the fixing hook 100 so as to be fittingly coupled to the retaining aperture 14 of the furniture hinge 10, and a clearance space 300 having a certain distance defined between the fixing hook 100 and the clearance hooks 200.

Moreover, the damper adapter 20 has a through-hole 500 formed therein in such a fashion as to communicate with the clearance space 300 so as to allow coupling protrusions 400 of a covering member 30, which will be described later, to be induced into the clearance space 300.

Also, the clearance hooks 200 may be formed at both sides or one side along a width direction of the fixing hook 100 as shown in FIGS. 4 and 5, and may be formed at both sides or one side along a lengthwise direction of the fixing hook 100 as shown in FIGS. 6 and 7.

Further, the clearance hooks 200 are preferably formed thinner than the fixing hook 100 so that they can be bent along the clearance space 300.

In addition, each of the clearance hooks 200 has at least one retaining jaw 210 integrally formed at the bottom portion thereof in such a fashion as to extend outwardly from an outer wall of the bottom portion thereof so as to be fixedly retained by a flange portion 14*a* formed an edge of the retaining aperture 14 in a state where the retaining jaw is fit into the retaining aperture 14.

Also, the covering member 30 is mounted on the damper adapter 20 and serves to close or open the check opening 22 of the damper adapter 20 to adjust the fastening state of the tension adjustment bolt 11 and the fixing bolt 15 of the furniture hinge 10. The covering member 30 includes: a body portion mounted on the top surface of the damper adapter 20; and fixing means integrally formed at the underside of the body portion so as to be fittingly coupled with the damper adapter 20.

In this case, the fixing means of the covering member 30 includes the coupling protrusions 400 fit into the clearance space 300 via the through-hole 500 of the damper adapter 20.

Preferably, the covering member 30 has a plurality of retaining hooks 31 formed on the underside thereof so as to be fittingly fixed to the top surface of the damper adapter 20.

Also, preferably, the coupling protrusions 400 are formed at positions of the covering member 30 corresponding to the clearance space 300 of the damper adapter 20 to have a contour corresponding to the clearance space 300. The coupling protrusions 400 may be formed at both sides or one side along a width direction of the covering member 30 as shown in FIGS. 4 and 5, and may be formed at both sides or one side along a lengthwise direction of the covering member 30 as shown in FIGS. 6 and 7.

In this case, the clearance space 300 of the damper adapter 20 is preferably defined to have a width corresponding to the thickness of each of the coupling protrusions 400.

Besides, the damper adapter 20 and the covering member 30 are preferably formed of a material excellent in machinability and elasticity such as plastic or rubber.

Now, the assembly and disassembly operation of the door hinge device according to the present invention will be described hereinafter in more detail with reference to FIGS. 5 and 7.

First, when it is desired to assemble the door hinge device of the present invention, the fixing hook 100 and the clearance hooks 200 of the damper adapter 20 are softly pressingly pushed downwardly into the retaining aperture 14 of the furniture hinge 10 while abutting against the retaining aperture 14 of the furniture hinge 10.

Then, the clearance hooks 200 abutting against the flange portion on the top surface of the furniture hinge 10 are fit into the retaining aperture 14 while being bent inwardly along the clearance space 300, and then are maintained in an upright state by means of intrinsic elasticity of the clearance hooks 200.

Subsequently, when the coupling protrusions 400 of the covering member 30 are softly pressingly pushed into the through-hole 500 of the damper adapter 20 while abutting against the through-hole 500, the covering member 30 is coupled to the top surface of the damper adapter 20.

That is, when the coupling protrusions 400 of the covering member 30 are fit into the clearance space 300 of the damper adapter 20 via the through-hole 500 of the damper adapter 20, a moving space of the clearance hooks 200 does not exist to cause the clearance hooks 200 to be maintained in an upright state.

Furthermore, the covering member 30 mounted on the damper adapter 20 is primarily securely fixed to the damper adapter 20 by means of the retaining hooks 31 as well as the retaining jaws 210 of the clearance hooks 200 are fixedly retained by the flange portion 14*a* of the retaining aperture 14 so as to prevent the escape of the door hinge device.

In the meantime, in case where it is desired to disassemble the door hinge device, when the covering member 30 is lifted slightly, the coupling protrusions 400 fit into the clearance space 300 of the damper adapter 20 is easily removed from the damper adapter 20.

In this case, since the clearance hooks 200 of the damper adapter 20 are bent at a given angle along the clearance space 300, the damper adapter 20 can be easily and readily separated from the furniture hinge 10.

Thus, the tension adjustment bolt 11 and the fixing bolt 15 of the furniture hinge 10 are checked through the check openings 22 of the damper adapter 20, and then the covering member 30 and the damper adapter 20 can be re-assembled to each other for the use of the door hinge device.

As described above, a door hinge device for absorbing the closing impact of a furniture door according to the present invention has the following advantageous effects.

First, since the assembly and disassembly of the door hinge device can be performed in a one-touch manner through the interaction between the damper adapter and the covering member, a convenience of the operation according to the assembly and disassembly of the door hinge device is improved as well as a work load is reduced.

Second, since the assembly and disassembly of the door hinge device is carried out in only a one-depression and pulling manner, it can be easily conducted even by a non-expert, thereby preventing a safety accident such as injury of hands and the like.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A door hinge device for absorbing the closing impact of a furniture door, the door hinge device comprising:

a furniture hinge (10) adapted to hingeably interconnect a side wall (W) of a piece of furniture and a furniture door (D) and having a retaining aperture (14) formed thereon;

a damper adapter (20) mounted to the furniture hinge (10) and having a fluid damper (21) built therein for absorbing the closing impact of the furniture door (D), the damper adapter (20) having a fixing hook (100) next to and a pair of clearance hooks (200) protrudingly formed downwardly from the underside thereof so as to be fittingly coupled to the retaining aperture (14), wherein the fixing hook (100) is disposed next to the clearance hooks (200) and a plurality of clearance spaces (300) are defined between the fixing hook (100) and each of the clearance hooks (200); and a covering member (30) mounted on the damper adapter (20) and having a plurality of coupling protrusions (400) formed on the underside thereof so as to be fit into the clearance spaces (300) via a through-hole (500) of the damper adapter (20), wherein the clearance hooks (200) of the damper adapter (20) are oriented toward the coupling protrusions (400) of the covering member (30) so as to be fixed by the retaining aperture (14).

2. The door hinge device according to claim 1, wherein the clearance hooks (200) are formed at the same side or the opposite sides of the fixing hook (100) along a width direction of the damper adapter (20).

3. The door hinge device according to claim 1, wherein the clearance hooks (200) are formed at the same side or the opposite sides of the fixing hook (100) along a lengthwise direction of the damper adapter (20).

4. The door hinge device according to claim 1, wherein each clearance space (300) is formed to have a width corresponding to the thickness of each of the coupling protrusions (400).

5. The door hinge device according to claim 1, wherein each of the clearance hooks (200) has a retaining jaw (210) integrally formed at the bottom portion thereof in such a fashion as to extend outwardly from an outer wall of the bottom portion thereof so as to be fixedly retained by a flange portion (14*a*) of the retaining aperture (14).

* * * * *